US008519899B1

(12) United States Patent
Volman et al.

(10) Patent No.: US 8,519,899 B1
(45) Date of Patent: Aug. 27, 2013

(54) PASSIVE ELECTROMAGNETIC POLARIZATION SHIFTER WITH DIELECTRIC SLOTS

(75) Inventors: Vladimir Volman, Newtown, PA (US); Daniel W. Harris, Mount Laurel, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 622 days.

(21) Appl. No.: 12/729,385

(22) Filed: Mar. 23, 2010

(51) Int. Cl.
*H01Q 19/00* (2006.01)

(52) U.S. Cl.
USPC ..... 343/756; 343/909

(58) Field of Classification Search
USPC ..... 343/756, 909, 911 R
See application file for complete search history.

(56) References Cited

U.S. PATENT DOCUMENTS 2,577,619 A * 12/1951 Kock ..... 343/753
2,887,684 A * 5/1959 Dexter et al. ..... 343/781 R
4,342,034 A 7/1982 Monser
4,551,692 A 11/1985 Smith
6,014,115 A * 1/2000 Ghaby et al. ..... 343/909
7,564,419 B1 7/2009 Patel

OTHER PUBLICATIONS

Arlon, Inc. brochure for AD410 Laminate, "PTFE/Woven Fiberglass/Micro-Ceramic Filled Laminate for RF & Microwave Printed Circuit Boards", 2008, 2009 Arlon Incorporated.
Arlon, Inc. brochure for AD1000 Laminate, "PTFE/Woven Fiberglass/Ceramic Filled Laminate for Microwave Printed Circuit Boards", 2008, 2009 Arlon Incorporated.

* cited by examiner

*Primary Examiner* — Hoang V Nguyen
*Assistant Examiner* — Kyana R McCain
(74) *Attorney, Agent, or Firm* — Howard IP Law Group, PC

(57) ABSTRACT

A dielectric-slot polarizer arrangement includes a first dielectric polarizer plate with first elongated aperture arrangement, and second and third dielectric polarizer plates, also defining elongated aperture arrangements parallel to or registered with the first aperture arrangement. The second and third dielectric plates sandwich the first plate. The bulk dielectric constant of the first plate exceeds that of the second and third plates. The effective perpendicular and parallel dielectric constants of the first plate exceed those of the second and third plates. Ideally, the dielectric plates are free of metal.

20 Claims, 12 Drawing Sheets

FRONT VIEW

PASSIVE ELECTROMAGNETIC POLARIZATION SHIFTER WITH DIELECTRIC SLOTS

BACKGROUND OF THE DISCLOSURE

The electromagnetic energy or "waves" transduced by an antenna to or from free space is or are characterized by "polarization." The free-space form of electromagnetic energy is "elliptically" polarized. A special form of elliptical polarization is termed "linear" or "circular" polarization. In linear polarization, the electric field (E) vector of the radiation remains fixed at a particular orientation relative to the environment over a complete cycle of the electromagnetic wave. The elliptical polarization can be consider as superposition of two mutual orthogonal components of linear polarization simultaneously coexisting and having in common case different magnitude and phase shift. These two components are often referred to as "Vertical" (V) or "Horizontal," (H) regardless of the actual orientation of the electric field vector relative to local vertical or horizontal. A special form of elliptical polarization is termed "circular" polarization and formed if these two mutual orthogonal linear components have equal magnitude and +−90° phase shift. In circular polarization, the electric field vector rotates about the direction of propagation once during each cycle of the electromagnetic wave, so that its projection onto a plane appears to "rotate." The direction of rotation of the electric field vector defines the left or right "hand" of circularity and defined the sign of 90-degrees phase shift. The antenna designer will ordinarily design his antenna to respond to either one (V or H) linear or both simultaneously.

U.S. Pat. No. 4,551,692, issued Nov. 5, 1985 in the name of Smith indicates that radar systems presently used frequently employ polarized microwave radiation for surveillance and to detect and track selected target objects. Such radar systems are subject to considerable undesired signal return from raindrops, causing clutter which tends to obscure the desired signals. This effect is particularly pronounced in the millimeter wavelength region because the dimensions of raindrops are approximately equal to the wavelength of the radiation. When circularly polarized microwave radiation is transmitted, the raindrops reflect an opposite sense of the transmitted circular polarization, which is then rejected by the radar antenna and specialized circuitry. The target reflects in the same sense of circular polarization as that transmitted, thereby permitting its direct observation unobscured by rain clutter. The forms of polarized microwave radiation most conveniently generated according to the design of radar antennas and feeds are linear forms of polarization. This has motivated the development of polarizer gratings effective for transforming linearly polarized microwave radiation to a circular form, and for transforming the return signal back to linear form upon return from a target region.

U.S. Pat. No. 7,564,419, issued Jul. 21, 2009 in the name of Patel describes a composite polarizer including a first polarizer having a plurality of metal vanes and also including a second polarizer having a plurality of parallel layers of dielectric material. The first and second polarizers are disposed along an axis and provide differential phase shifts at frequencies f1 and f2. A total of the first differential phase shifts is about 90°, and a total of the second differential phase shifts is also about 90°. The result is that relative rotation of the polarizers allows linear polarization to pass, or allowing conversion of between linear and elliptical polarization and selection of right- or left-handedness for elliptical and circular polarization. The main problem of all polarizers with metal inclusions (vanes, meander lines, etc.) at millimeter-wave frequencies or higher is high Ohmic loss caused by strong skin effect.

Improved polarizers are desired.

SUMMARY OF THE DISCLOSURE

A source of nominally circularly polarized electromagnetic energy according to an aspect of the invention comprises a source of linearly polarized electromagnetic energy. The linearly polarized electromagnetic energy propagates parallel to a given straight line away from the source of linearly polarized electromagnetic energy. The source also includes a generally planar first dielectric slab defining first and second generally planar, mutually parallel broad surfaces. The first dielectric slab lies on the line with one of the first and second surfaces orthogonal to the straight line. The first dielectric slab defines at least a first aperture arrangement extending from the first broad surface to the second broad surface through the first dielectric slab. The first aperture arrangement is elongated in a direction skewed relative to the direction of polarization of the linearly polarized electromagnetic energy, so that a vertical component of the linearly polarized electromagnetic energy passing through the first dielectric slab encounters a first effective vertical dielectric constant and a horizontal component of the linearly polarized electromagnetic energy passing through the first dielectric slab encounters a first effective horizontal dielectric constant. The value of the first effective horizontal dielectric constant is different than the first effective vertical dielectric constant. The source also includes second and third generally planar dielectric slabs. The second dielectric slab defines first and second generally planar, mutually parallel broad surfaces. The third dielectric slab defines first and second generally planar, mutually parallel broad surfaces. The second generally planar dielectric slab lies on the straight line with one of the first and second broad surfaces orthogonal to the line. The second dielectric slab lies at a location on the straight line between the source of linearly polarized electromagnetic energy and the first dielectric slab. The second dielectric slab defines at least one through aperture arrangement extending from the first to the second broad surfaces. The through aperture arrangement of the second dielectric slab is elongated in a direction skewed relative to the direction of polarization of the linearly polarized electromagnetic energy, so that a vertical component of the linearly polarized electromagnetic energy passing through the second dielectric slab encounters a second effective vertical dielectric constant, the value of which is less than the value of the first effective vertical dielectric constant, and a horizontal component of the linearly polarized electromagnetic energy passing through the second dielectric slab encounters a second effective horizontal dielectric constant, the value of which is less than the value of the first effective horizontal dielectric constant. The third generally planar dielectric slab lies on the straight line with one of the first and second broad surfaces orthogonal to the straight line. The third dielectric slab lies at a location on the straight line which is remote from the second dielectric slab and from the source of linearly polarized electromagnetic energy. The third dielectric slab defines at least one through aperture arrangement extending from the first broad surface to the second broad surface. The through aperture arrangement of the third dielectric slab is elongated in a direction skewed relative to the direction of polarization of the linearly polarized electromagnetic energy, so that a vertical component of the linearly polarized electromagnetic energy passing through the third dielectric slab encounters the second effective vertical dielectric constant and a horizontal component of the linearly polarized electromagnetic energy passing through the third dielectric slab encounters the second effective horizontal dielectric constant. In a particular embodiment, the first effective vertical dielectric constant is selected to exceed the second effective vertical dielectric constant in a given ratio, and the first effective horizontal dielectric constant is selected to exceed the second effective horizontal dielectric constant in the same given ratio. The first surface of the second dielectric slab in one embodiment is juxtaposed with the second surface of the first dielectric slab, and the first surface of the first dielectric slab is juxtaposed with the second surface of the third dielectric slab. The juxtaposed surfaces may be fused together. In one version, the aperture arrangement comprises a slot defining the direction of elongation, and in another version, the aperture arrangement comprises a plurality of separate apertures lying along the direction of elongation. The first and second generally planar dielectric slabs have different bulk dielectric constants. One embodiment further comprises a stiffening dielectric panel affixed to at least one of the second and third dielectric slabs. This stiffening dielectric panel has an isotropic dielectric constant in a direction parallel to the straight line. Alternatively, the source may comprise a honeycomb dielectric panel affixed to at least one of the first, second and third dielectric slabs, the honeycomb dielectric panel having an isotropic dielectric constant in a direction parallel to the straight line.

A method according to another aspect of the disclosure is for making a phase shifter for electromagnetic energy. The method comprises the steps of stacking a plurality of generally planar dielectric sheets to produce a stack of dielectric sheets, with those dielectric sheets toward the center of the stack being selected to have a greater bulk dielectric constant than those dielectric sheets toward the ends of the stack. The mutually adjacent surfaces of the dielectric sheets of the stack are fused to thereby generate a unitary structure. The fusion may be heat fusion. A first elongated aperture arrangement is generated, the aperture arrangement extending through all of the dielectric sheets of the stack. The first elongated aperture arrangement defines an axis of elongation. At least a second elongated aperture arrangement extending through all of the dielectric sheets of the stack is generated. The second elongated aperture has an axis of elongation parallel to the axis of elongation of the first elongated aperture arrangement. In a particular mode of this method, the step of generating a first elongated aperture arrangement comprises the step of generating a first elongated slot defining the axis of elongation, and the step of generating a second elongated aperture arrangement comprises the step of generating a second elongated slot defining an axis of elongation parallel to the axis of elongation of the first slot. In an alternative mode of the method, the step of generating a first elongated aperture arrangement comprises the step of generating a series of mutually separated apertures, the mutually separated apertures of the first aperture arrangement extending along the axis of elongation, and step of generating a second elongated aperture arrangement comprises the step of generating a series of mutually separated apertures, the mutually separated apertures of the second elongated aperture arrangement extending along an axis of elongation which is parallel with the axis of elongation of the first aperture arrangement.

DESCRIPTION OF THE DISCLOSURE

Figure 1A:
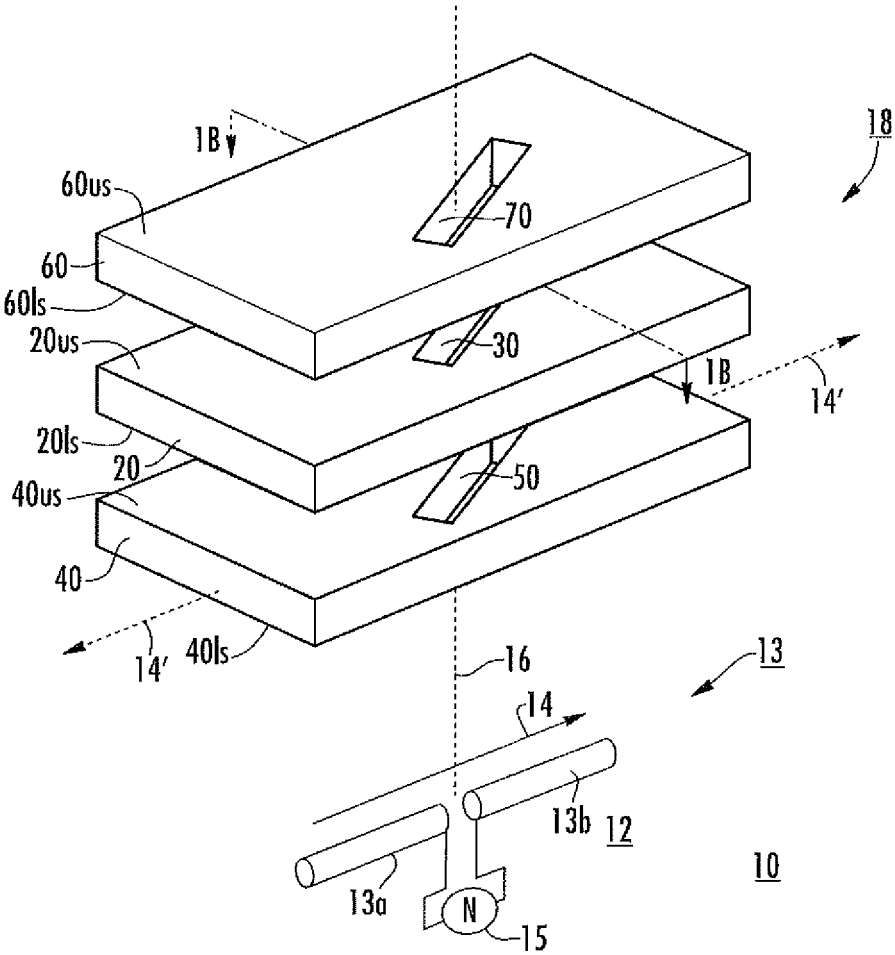
FIG. 1A is a simplified perspective or isometric view of an elliptically polarized source including a linear electromagnetic signal source together with a polarization shifter according to an aspect of the disclosure.

In FIG. 1A, a device 10 of elliptical or nominally circular polarization includes a source 12 of linearly polarized radiation, represented by a notional electric field vector 14. For the sake of simplicity, linear polarized source 12 is shown as a dipole 13 with first and second mutually coaxial conductors 13*a* and 13*b*, the feed end of which dipole is connected to a source 15 of electrical oscillation. As known, the vector of electrical field 14 propagates away from source 12 as a perpendicular to a line 16.

Also in FIG. 1A, a stack 18 of dielectric slabs 20, 40, and 60 is illustrated exploded to reveal certain details. Dielectric slab 20 includes a generally planar upper surface 20*us* and a generally planar lower surface 20*ls*. Similarly, dielectric slab 40 includes a generally planar upper surface 40*us* and a generally planar lower surface 40*ls*, and dielectric slab 60 includes a generally planar upper surface 60*us* and a generally planar lower surface 60*ls*. The dielectric slabs 20, 40, and 60 are disposed with their upper and lower surfaces mutually parallel, and with their upper and lower surfaces intercepting or intercepted by propagation path or line 16. While the dielectric slabs of FIG. 1A are illustrated as exploded away from each other (it can be), those skilled in the art will understand that the upper surface 20*us* of dielectric slab 20 is juxtaposed with the lower surface 60*ls* of dielectric slab 60, and the lower surface 20*ls* of dielectric slab 20 is juxtaposed with the upper surface 40*us* of dielectric slab 40 (not by definition, can be additional slabs to improve matching).

As illustrated in FIG. 1A, each of dielectric slabs 20, 40, and 60 of stack 18 defines a through aperture or slot 30, 50, and 70, respectively. More particularly, pierced dielectric slab 20 defines a slot 30 extending from upper surface 20*us* to lower surface 20*ls*, dielectric slab 40 defines a slot 50 extending from upper surface 40*us* to lower surface 40*ls*, and dielectric slab 60 defines a slot 70 extending from upper surface 60*us* to lower surface 60*ls*. In FIG. 1A, the projection of the linear polarization vector 14 is illustrated by the dash line 14'.

In stack 18 of FIG. 1A, pierced dielectric slab 40 lies between pierced dielectric slab 20 and linear source 12, and pierced dielectric slab 60 is remote (not in all cases) from source 12 and from dielectric slab 40 relative to slab 20. In FIG. 1A, dielectric slab 20 is a "polarizer" slab or "main" polarizer slab, and dielectric slabs 40 and 60 are "matching" slabs, which also provide some degree of polarizing, so slabs 40 and 60 may be termed "matching/polarizing" slabs.

Figure 1B:
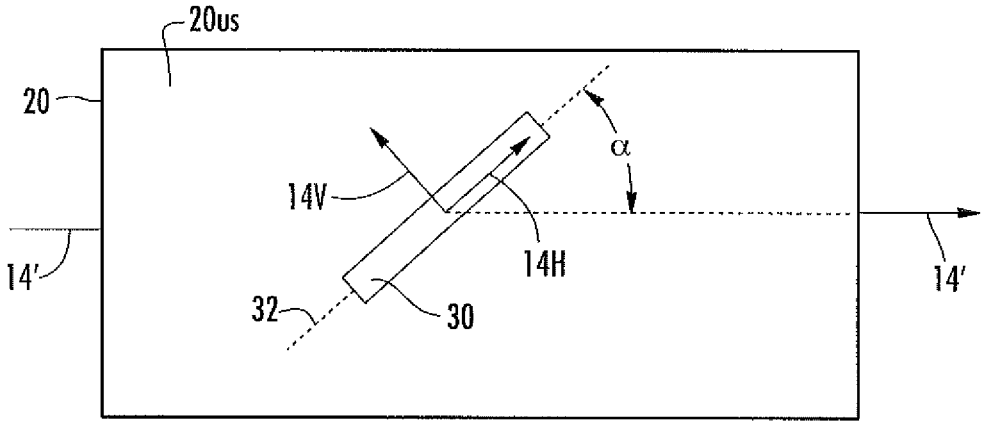
FIG. 1B is a sectional plan view of the arrangement of FIG. 1A.

FIG. 1B is a plan view of the upper surface 20*us* of dielectric slab 20. In FIG. 1B (wrong 14V direction), the direction of the electric field vector 14' is indicated, together with a dash line 32 indicating the direction of elongation of slot 30. The direction of elongation of slot 30 lies at an angle of a relative to direction 14' in a plane parallel with the surface 20*us*. Also in FIG. 1B, two mutually orthogonal components of the linear radiation 14 arriving at dielectric slab 20 are illustrated as 14V and 14H. As mentioned, these are merely identifications, and do not necessarily indicate or relate to the actual orientation of the field components.

Those skilled in the art know that a single set of polarizing slots such as slots 30, 50, and 70 of FIG. 1A will convert polarization, but are ordinarily accompanied by additional slots oriented parallel therewith to improve the polarization conversion efficiency. In FIG. 1B, slot 30 of dielectric slab 20 is seen to lie at a 45° angle relative to the direction of electric field line 14'. The direction of electric field line 14' can be resolved into a first "horizontal" component 14H which lies parallel with the direction of elongation of the slot 30 and a second "vertical" component 14V which lies orthogonal to the direction of elongation of the slot 30.

Figure 2A:
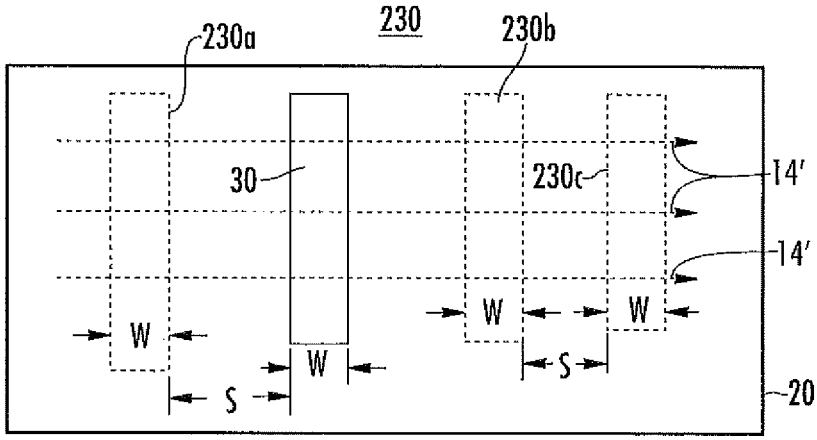
FIG. 2A is a simplified plan view of a dielectric slab defining a plurality of mutually parallel through slots, the axes of elongation of which are orthogonal or normal to the direction of the linear vertical component of polarization passing therethrough.

FIG. 2A is a simplified plan representation of a surface of dielectric slab or plate 20, with slot 30 designated, and with additional slots 230*a*, 230*b*, and 230*c* of a set 230 of slots illustrated by dash outlines. The direction of elongation of the slots of set 230 of FIG. 2A is illustrated as being perpendicular to the direction 14' of the linear polarization 14'. In FIG. 2A, the slots of set 230 have a particular width w and a particular inter-slot spacing S. The bulk dielectric material of dielectric slab 20 of FIG. 2A has a relative dielectric constant of $\in_{R20}$. The effective dielectric constant $\in_{rV}$ presented by slotted layer 230 to the electric field represented by arrow 14V will depend upon the width of the slots and their center-to-center spacing.

Figure 2B:
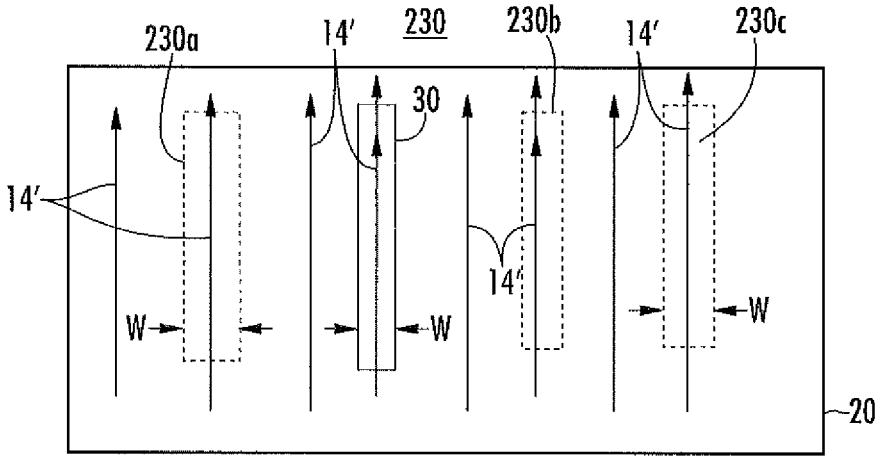
FIG. 2B is a plan view of the same dielectric slab defining a plurality of mutually parallel through slots, the axes of elongation of which are parallel to the direction of the linear horizontal component of polarization.

FIG. 2B is a simplified plan representation of a surface of dielectric slab or plate 20, with slot 30 designated, and with additional slots 230*a*, 230*b*, and 230*c* of set 230 illustrated by dash outlines. The direction of elongation of the slots of set 230 is illustrated as being parallel to the direction 14H of the applied linear polarization. In FIG. 2B, the slots of set 230 have the same width w and a particular inter-slot spacing S. It has been discovered that the effective dielectric constant differs as between the parallel 14H and the perpendicular 14V polarization components. It will be clear that the effective parallel relative dielectric constant depends upon the width of the slots and their center-to-center spacing.

Figure 3:
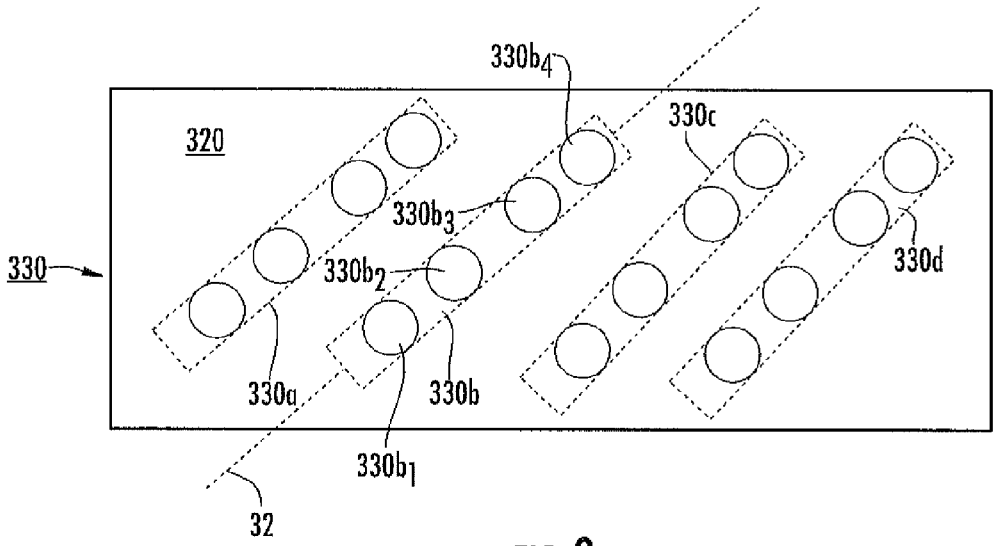
FIG. 3 is a simplified plan view of a dielectric slab with elongated patterns of circular through holes rather than elongated slots as in FIG. 2A.

FIG. 3 illustrates a generally planar slab 320 of dielectric material. A plurality of sets 330 of apertures includes sets 330*a*, 330*b*, 330*c*, and 333*d*. Each set of apertures is illustrated as having four circular through holes. More specifically, set 330*b* of apertures includes apertures 330*b*1, 330*b*2, 330*b*3, and 330*b*4. The only reason that the apertures are circular is that drill bits tend to make circular holes. Other shapes of apertures may be used. The use of separate apertures in each set of apertures tends to retain strength in the slab by comparison with the use of continuous slots, which by definition do not have cross support.

Figure 4:
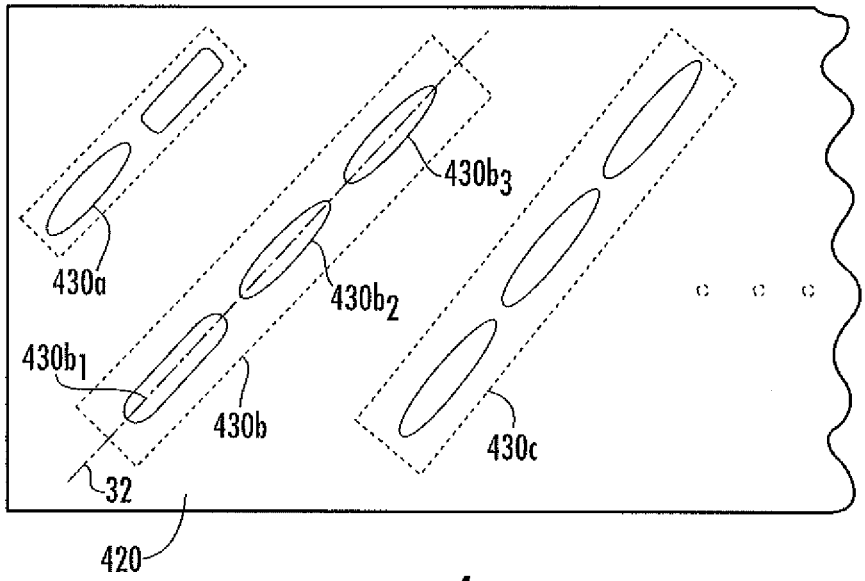
FIG. 4 illustrates in plan view a dielectric slab with a plurality of aperture sets, each of which includes a plurality of mutually coaxial slot apertures.

In a preferred embodiment of the disclosure, each set of apertures comprises a plurality of discontinuous, coaxial slots. FIG. 4 illustrates in plan view a dielectric slab 420 with a plurality of slot aperture sets 430*a*, 430*b*, 430*c*, . . . . More specifically, slot set 430*b* includes a set of discontinuous, mutually coaxial slots 430*b*1, 430*b*2, 430*b*3.

Figure 5:
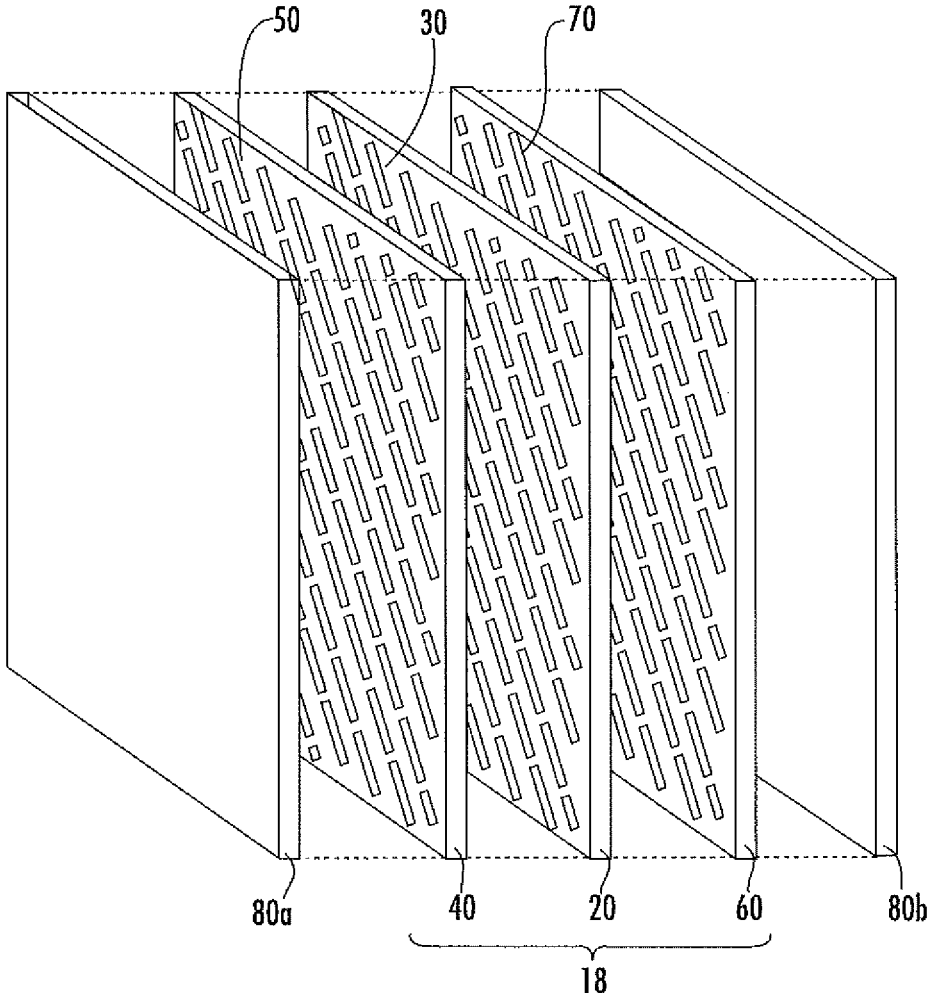
FIG. 5 is a simplified diagram of a plurality of slotted dielectric slabs juxtaposed to provide impedance matching, and also including protective or stiffening sheets of dielectric material.

FIG. 5 is a simplified, exploded view of a polarizer according to an aspect of the disclosure. Elements of FIG. 5 corresponding to those of FIGS. 1A and 1B are designated by like reference numerals. More particularly, a representative one of the through apertures in dielectric slab 20 of FIG. 5 is a slot designated 30. Similarly, representative ones of the through apertures in dielectric slabs 40 and 60 of FIG. 5 are slots designated 50 and 70, respectively. Additional dielectric slabs are illustrated as being associated with the exterior of stack 18. More particularly, a dielectric slab 80*a* is illustrated as being adjacent to dielectric slab 40 and remote from slab 20, and a further dielectric slab 80*b* is illustrated as being adjacent to dielectric slab 60 and remote from slab 20. The additional dielectric slabs 80*a* and 80*b* are stiffening or support slabs. Of course, when the structure of FIG. 5 is assembled into a stack, slabs 80*a* and 80*b* are made into a monolithic whole with slabs 30, 40, and 60. The connection between or among the slabs may be by fusion or by means of an adhesive material such as epoxy. As described in conjunction with the stack 18 of FIG. 1A, many more pierced dielectric slabs may be used than the three illustrated.

According to an aspect of the disclosure, the effective dielectric constants of the stacked pierced dielectric slabs are selected to reduce or minimize reflections of the electromagnetic waves entering and or leaving the stack. The reduction of reflections is often known as "matching," and has the advantage of reducing losses attributable to the reflections. This matching may be accomplished by selecting the effective dielectric constant of the center slab of the stack to have a greater value than that of any of the other layers. Put another way, the effective dielectric constants of the pierced dielectric slabs decreases with distance from the center slab (20) of the stack (18). In effect, this creates a step change in impedance between free space and that (or those) dielectric slabs having the greatest values of dielectric constant.

While good matching can be achieved by using many layers of pierced dielectric slabs in the stack, and by selecting very small changes in effective dielectric constant from the center of the stack to the exterior of the stack, there will often be weight and cost constraints on the number of slabs which can be used in the stack. There is also the practical problem of finding sources of dielectric material having small incremental changes in dielectric constant.

In an actual embodiment similar to that of FIG. 5, center pierced dielectric slab 20 is made from dielectric with highest constant and provides most part of 90-degrees phase shift required for achieving the circular polarization. The thickness d of slab 20 can be obtained from $$d_{20} = \frac{\Delta\varphi_{20}}{2\pi}\frac{\lambda}{\sqrt{\varepsilon_{effH}^{(20)}}-\sqrt{\varepsilon_{effV}^{(20)}}} \text{ and } \Delta\varphi_{20} < \pi/2 \text{ is the differential phase shift}$$

The effective dielectric constant of slabs 40 and 60 must be $$\in_{effH}^{(40)}=\in_{effH}^{(60)}=\sqrt{\in_{effH}^{(20)}}$$

$$\in_{effV}^{(40)}=\in_{effV}^{(60)}=\sqrt{\in_{effV}^{(20)}}$$

The thickness of slabs 40 and 60 must be chosen to match the slab 20 with free space $$d_{40} = d_{60} \approx \frac{\lambda}{8}\left(\frac{1}{\sqrt{\varepsilon_{effH}^{(40)}}}+\frac{1}{\sqrt{\varepsilon_{effV}^{(40)}}}\right)$$

The additional differential phase shift created by the slabs 40 and 60 is much less than from slab 20 and equals $$\Delta\varphi_{40} = \Delta\varphi_{60} \approx \frac{2\pi}{\lambda}\left(\sqrt{\varepsilon_{effH}^{(40)}}-\sqrt{\varepsilon_{effV}^{(40)}}\right)d_{40}$$

Since we need to simultaneously achieve good match and good axial ratio, the final values of all dielectric constants and thicknesses are estimated as a result of parametric optimization using the equation $$\Delta\phi=2\Delta\phi_{40}+\Delta\phi_{20}\approx\pi/2$$

Since the only variable in this equation is the thickness of slab 20, this optimization can be done using a simple calculator. For more precise optimization any of available electromagnetic tools (HFSS, CST, etc.) can be used. For example, Arlon AD1000 dielectric material, which has a bulk dielectric constant $\in_R$=10.2, and the two side pierced dielectric slabs 40 and 60 are made from Arlon AD410 material, which has a relative bulk dielectric constant $\in_R$=3.66. The thickness of center slab 20 is 0.065 inches, and the thickness of each side slab 40 and 60 is 0.050 inches. Arlon AD1000 and Arlon AD410 are trade names of Arlon Incorporated company, which is located at 2811 S. Harbor Blvd., Santa Ana, Calif. 92704 and the telephone number of which is 1-800-854-0361. The Arlon layers of dielectric material are joined to each other along their major or broad surfaces by fusion bonding. The stiffening and environmental protection layers of dielectric 80*a* and 80*b* are each 250 mil thick honeycomb panels which also stiffen the assembly while having a relative dielectric constant within the honeycomb which is close to air. The honeycomb panels are joined to the Arlon layers using a room temperature cured epoxy.

In the embodiment using Arlon and honeycomb dielectric slabs, the slots are 0.762 millimeters (mm) wide, with the same gap between them. The slots are registered from layer to layer.

Figure 6A:
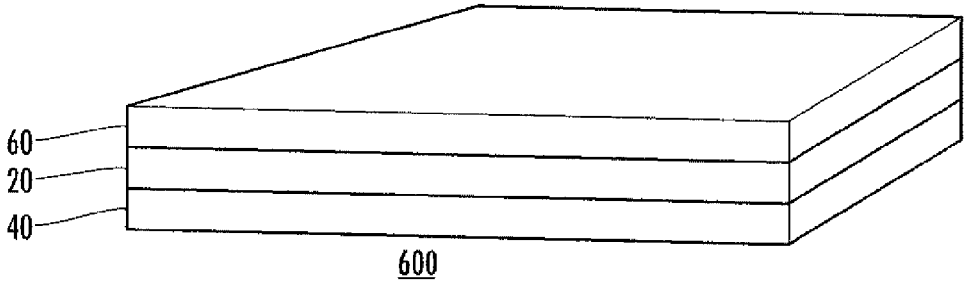
FIG. 6A is a simplified perspective or isometric view of three juxtaposed slabs of dielectric.
Figure 6B:
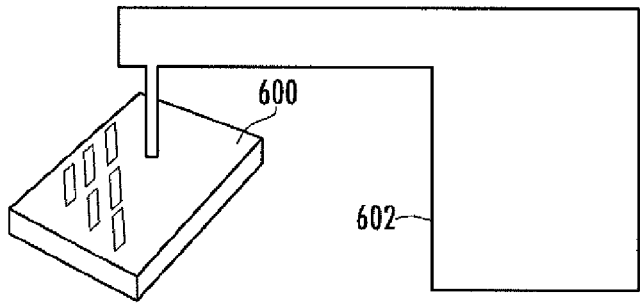
FIG. 6B illustrates the juxtaposed slabs of FIG. 6A in the process of having slots milled thereinto by a milling machine.
Figure 6C:
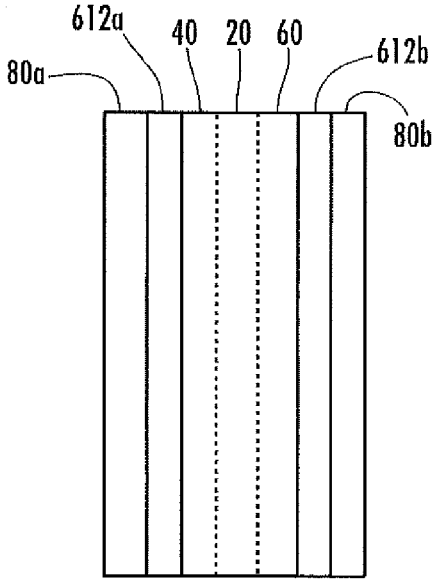
FIG. 6C is an edge view of the slotted dielectric sheet of FIG. 6B with protective layers of dielectric material attached.

The structure of the embodiment of FIG. 5 can be fabricated by making a stack 600 of dielectric slabs with dielectric constants distributed, as described in conjunction with FIG. 6A, with the slabs 40 and 60 of lowest effective dielectric constants on the outside of the stack and the highest effective dielectric constant slab 20 at or near the center of the stack. The juxtaposed broad surfaces of the layers are fused, as by use of heat. The Arlon materials surface fuse at temperatures of about 300°. The next step in fabrication is to generate the slots through all the fused layers, as suggested by the milling machine 602 of FIG. 6B acting on fused stack 600. The fused stack 600 is coated on each broad side (except, of course, at the locations of the slots) with an adhesive such as epoxy, designated 612*a* and 612*b*, and then the environmental covers 80*a* and 80*b* are applied to the adhesive. If necessary, the adhesive may be cured, as by application of heat.

Figure 7:
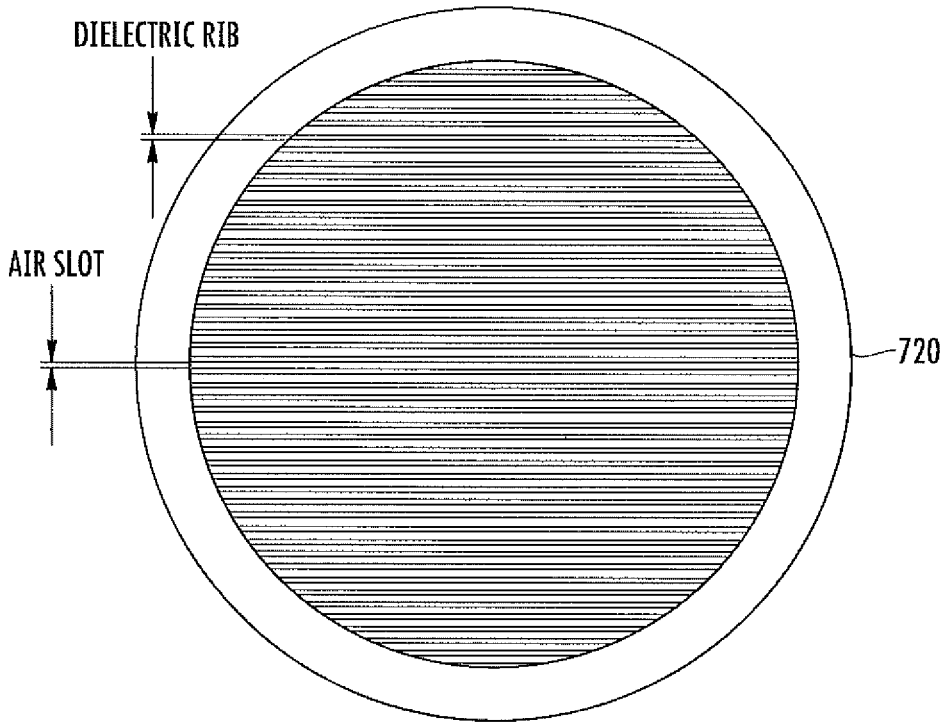
FIG. 7 is a plan view of a slotted single layer or slab of dielectric which may be used either as a polarizer or as a matching/polarizing slab.

FIG. 7 is a plan view of a slotted dielectric slab 720 with a certain bulk dielectric constant $\in_R$ and certain effective dielectric constant $\in_{eff}$. A plane wave impinging parallel upon the dielectric slab reflects by the reflection coefficient $$|\Gamma|^2 = \left|\frac{\sqrt{\varepsilon_{eff}}-1}{\sqrt{\varepsilon_{eff}}+1}\right|^2 \tag{3}$$

The corresponding mismatching loss attributable to mismatch is given by $$10\log_{10}(1-|\Gamma|^2) \tag{4}$$

Since the effective dielectric constant depends upon polarization (vertical or horizontal) the reflection coefficient also depends upon polarization. In this case, we can simultaneously provide matching for both polarizations.

Figure 8A:
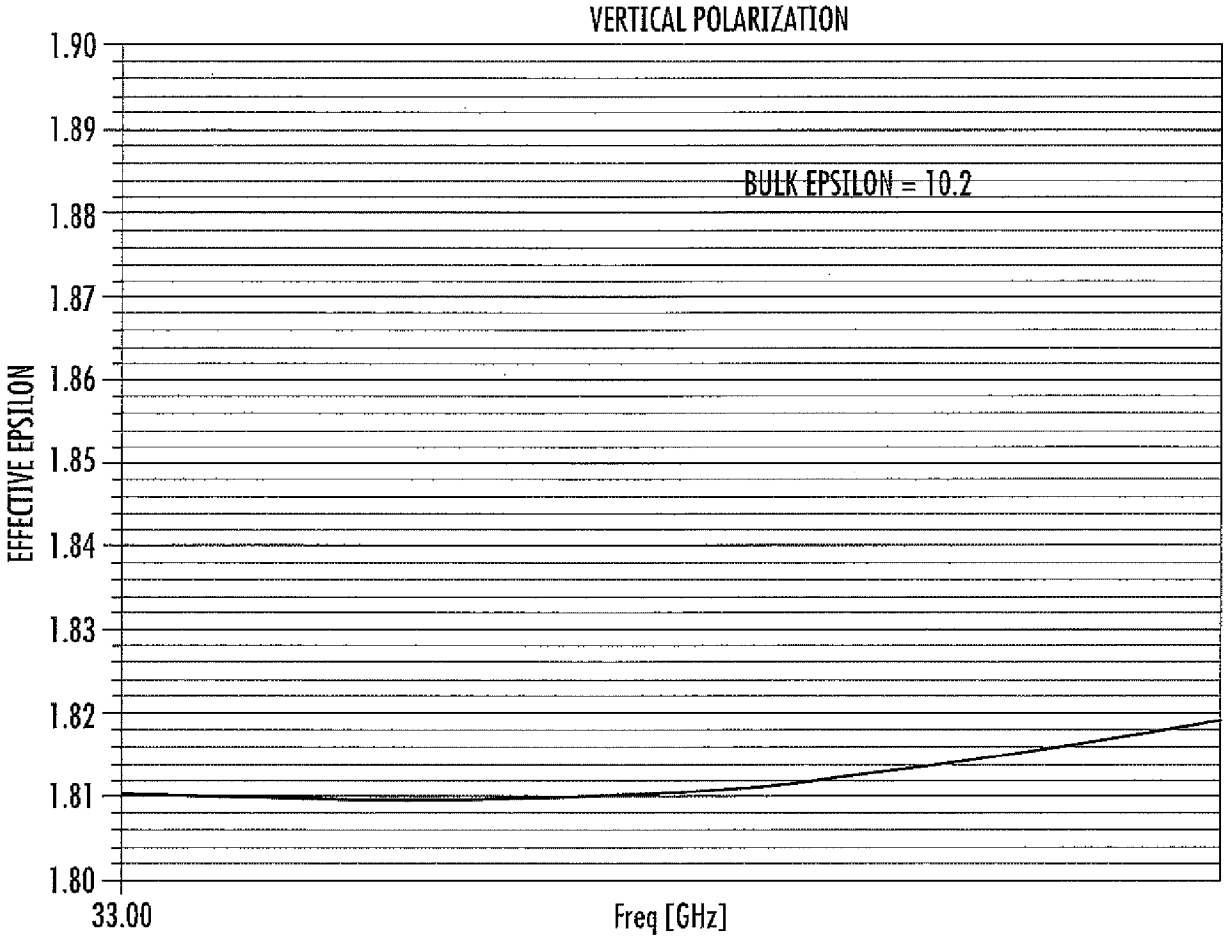
FIG. 8A is a plot of the effective dielectric constant of the slotted single layer of FIG. 7 when used as a main polarizer to linearly polarized electromagnetic wave 14V in a direction normal or orthogonal to the slot direction.
Figure 8B:
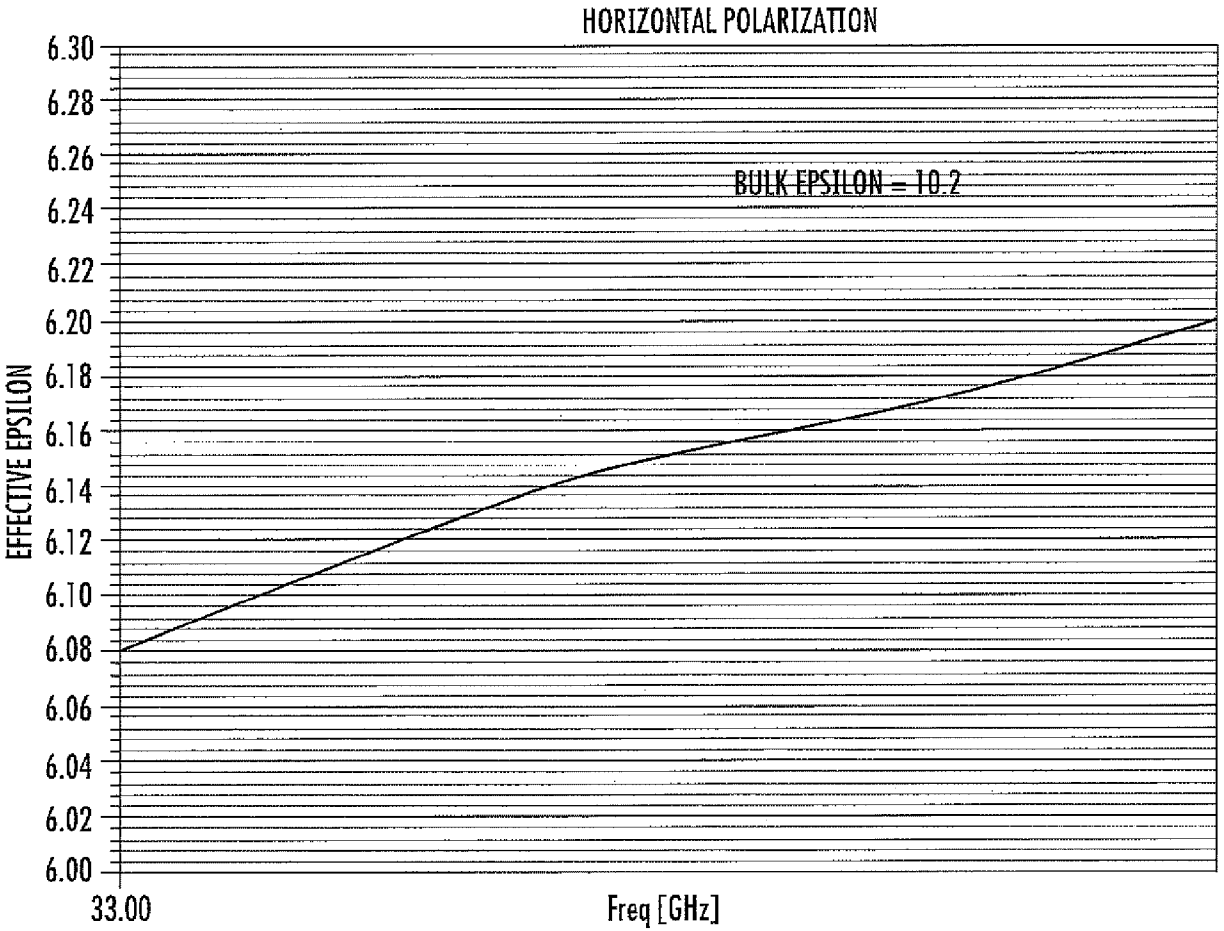
FIG. 8B is a plot of the effective dielectric constant of the slotted single layer of FIG. 7 to linearly polarized electromagnetic wave 14H in a direction parallel to the slot direction.

If the slab 720 of FIG. 7 were to be used as a polarizer, without matching elements, with bulk dielectric constant $\in$=10.2, and with vertical effective dielectric constant of about 1.81 and horizontal effective dielectric constant of about 6.15 as illustrated in FIGS. 8A and 8B, respectively, the vertical-polarization reflected power proportional to $|\Gamma|_V^2$ would be 0.14725 and the horizontal-polarization reflection power proportional to $|\Gamma|_H^2$ would be 0.42560. The corresponding vertical insertion loss attributable to reflection would be 0.69 dB and the parallel insertion loss would be 2.41 dB. These differences affect the magnitudes of the H and V components leaving the polarizer to cause a difference of about 2 dB. This difference is enough to result in substantial noncircularity of the circular polarization.

Figure 9:
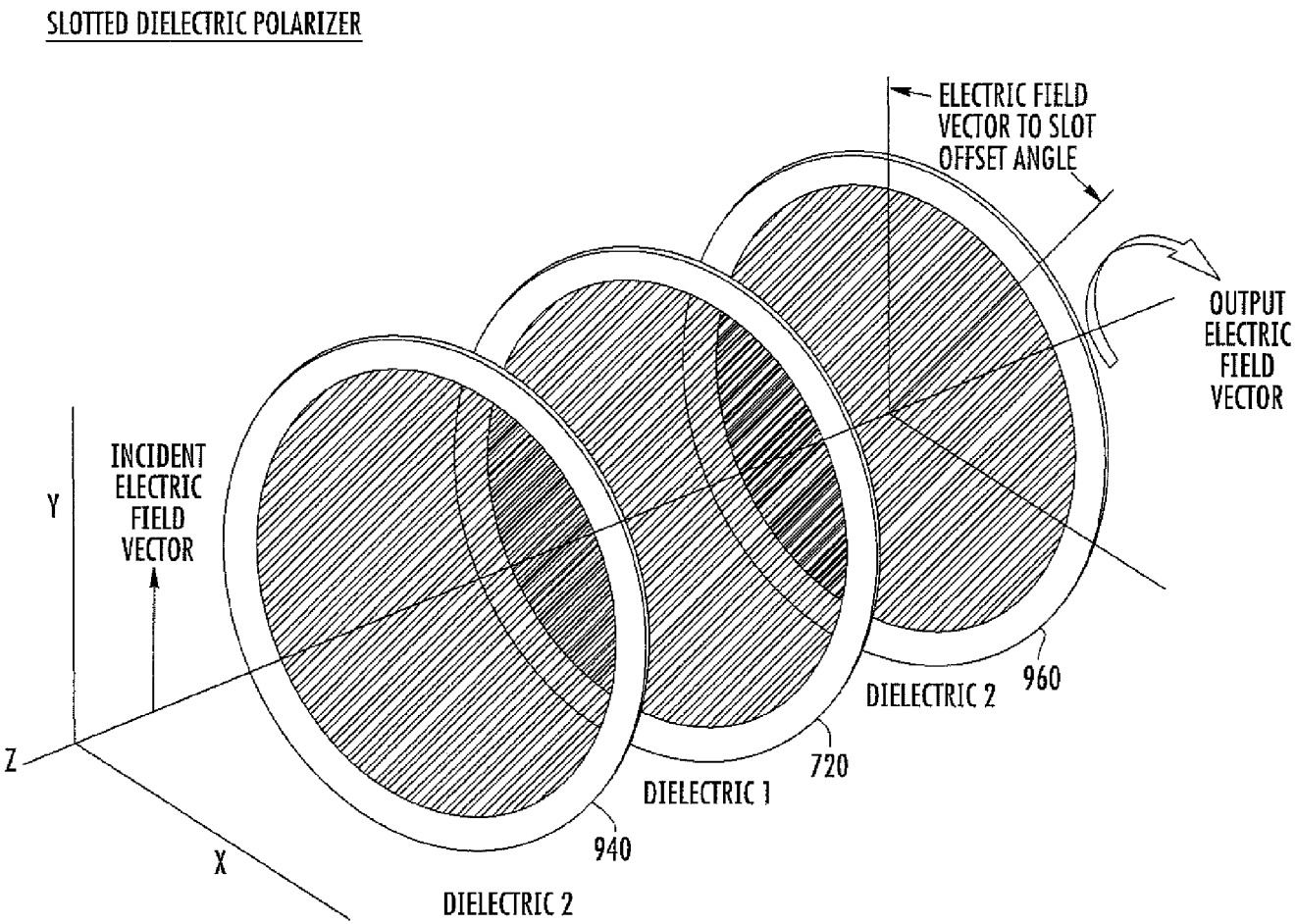
FIG. 9 is a simplified exploded view of a matched polarizer according to an aspect of the disclosure, including the polarizer of FIG. 7 and slotted matching layers.
Figure 10A:
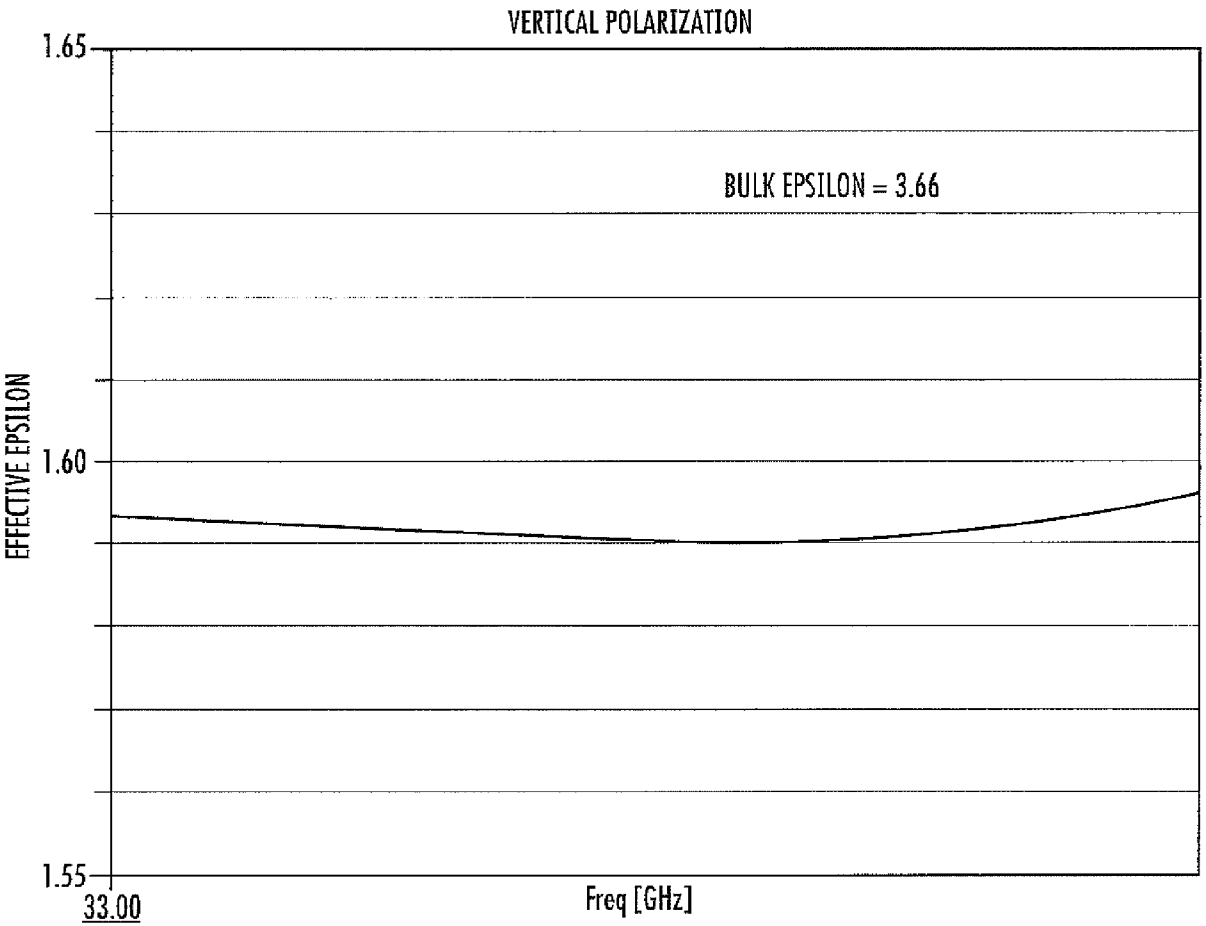
FIG. 10A is a plot of the effective dielectric constant of the slotted single layer of FIG. 7 when used as a matching/polarizing slab to linearly polarized electromagnetic wave 14V in a direction normal or orthogonal to the slot direction.
Figure 10B:
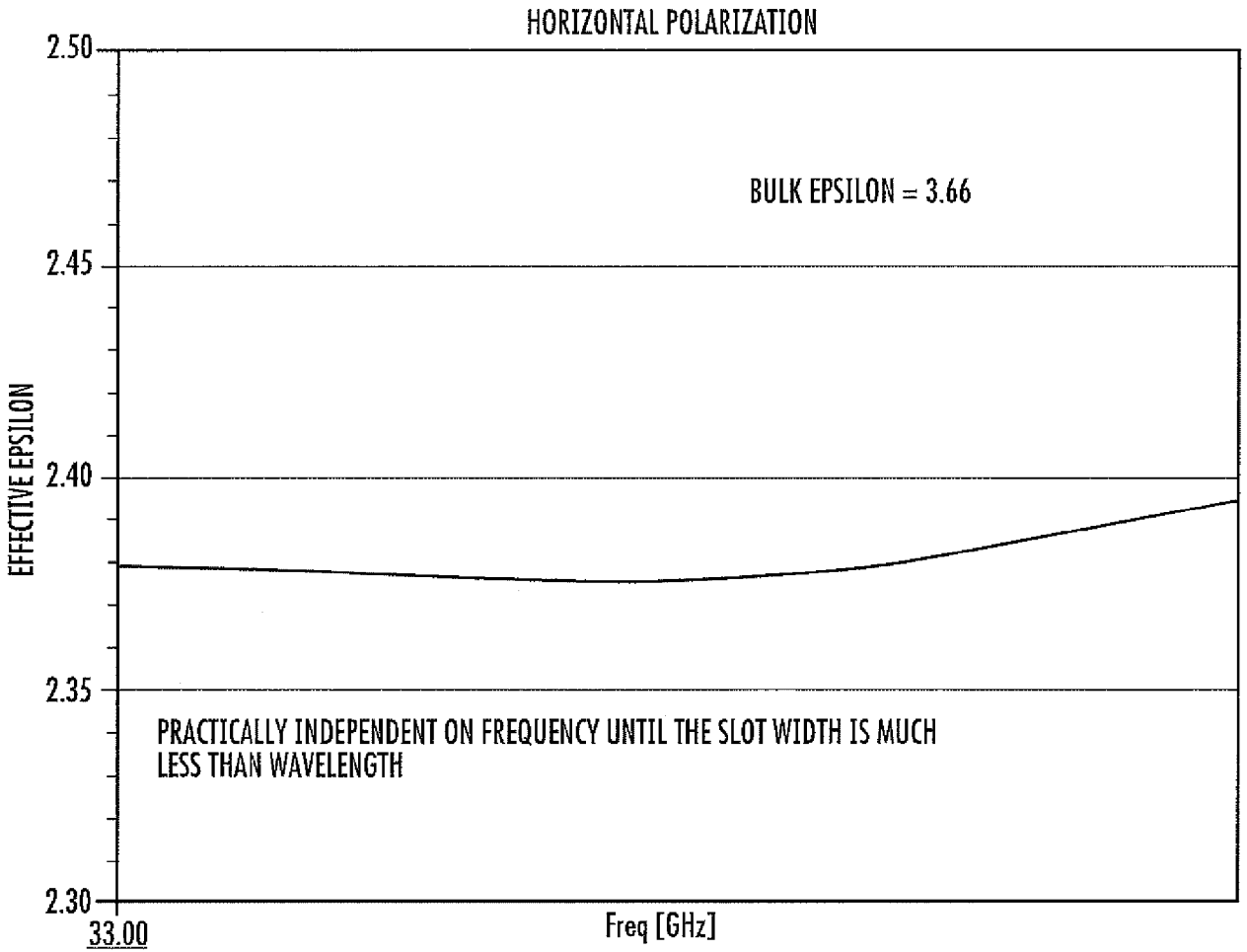
FIG. 10B is a plot of the effective dielectric constant of the slotted single layer of FIG. 7 to linearly polarized electromagnetic wave 14H in a direction parallel to the slot direction.

According to an aspect of the disclosure, matching layers are used to reduce the insertion loss attributable to mismatch. FIG. 9 is a simplified representation of a matched polarizer. In FIG. 9, the structure includes a slotted central "polarizer" dielectric slab 720 of a first dielectric material (dielectric 1), sandwiched between second and third slotted "matching" dielectric slabs 940, 960, of a second dielectric material (dielectric 2). As illustrated, and in conformance with FIG. 1A, the slots are registered with each other. In an exemplary embodiment, the bulk dielectric constant of the polarizer material (dielectric 1) is selected to be 10.2, and the bulk dielectric constant of the matching dielectric (dielectric 2) is selected to be 3.66. The spacing between slots is 0.762 millimeters (mm) and the width of the slots is also 0.762 mm, corresponding to the dimensions associated with the polarizer 720 of FIG. 7. The effective perpendicular or vertical dielectric constant $\in_{effV}$ of a slotted outer matching layer 940 or 960 is about 1.59 as illustrated in FIG. 10A, and the parallel or horizontal dielectric constant $\in_{effH}$ of each slotted outer layer is about 2.38. In order to match free space ($\in_R=1$) to the center polarizer 720, the outer or matching layer must have an approximate thickness of $$\frac{\lambda_0}{4\sqrt{\varepsilon_{eff}}}$$

In order to maintain approximately 90 degrees of phase shift between the parallel and perpendicular polarizations, the thickness of the center or polarizing layer is determined by numerical optimization of the phase shift as a function of thickness.

The theoretical values for perfect match of the polarizer is sqrt (1.81)=1.34 for normal polarization, and sqrt (6.16)=2.48 for parallel polarization. In practice, perfect match is difficult to achieve, but an actual embodiment for use at millimeter wave bands gave values of 1.59 and 2.38, respectively. This reduces the insertion loss to about 0.2 dB from an estimated 1.0 dB for the polarizer alone. Put another way, the improvement in insertion loss is estimated to be by a factor of five by comparison with an equivalent meander-line polarizer.

A source (10) of nominally circularly polarized electromagnetic energy according to an aspect of the invention comprises a source (12) of linearly polarized electromagnetic energy (14). The linearly polarized electromagnetic energy (14) propagates parallel to a given straight line (16) away from the source of linearly polarized electromagnetic energy (12). The source also includes a generally planar first dielectric slab (20) defining first (20*us*) and second (20*ls*) generally planar, mutually parallel broad surfaces. The first dielectric slab (20) lies on the line (16) with one of the first (20*us*) and second (20*ls*) surfaces orthogonal to the straight line (14). The first dielectric slab (20) defines at least a first aperture arrangement (30) extending from the first (20*us*) broad surface to the second (20*ls*) broad surface through the first dielectric slab (20). The first aperture arrangement (30) is elongated in a direction (32) skewed relative to the direction of polarization (14') of the linearly polarized electromagnetic energy (14), so that a vertical component of the linearly polarized electromagnetic energy passing through the first dielectric slab (20) encounters a first effective vertical dielectric constant and a horizontal component of the linearly polarized electromagnetic energy passing through the first dielectric slab (20) encounters a first effective horizontal dielectric constant. The value of the first effective horizontal dielectric constant is different than the first effective vertical dielectric constant. The source also includes second (40) and third (60) generally planar dielectric slabs. The second dielectric slab (40) defines first (40*us*) and second (40*ls*) generally planar, mutually parallel broad surfaces. The third (60) dielectric slab defines first (60*us*) and second (60*ls*) generally planar, mutually parallel broad surfaces. The second generally planar dielectric slab (40) lies on the straight line (16) with one of the first (40*us*) and second (40*ls*) broad surfaces orthogonal to the line. The second dielectric slab (40) lies at a location on the straight line between the source of linearly polarized electromagnetic energy (12) and the first dielectric slab (20). The second dielectric slab (40) defines at least one through aperture arrangement (50) extending from the first (40*us*) to the second (40*ls*) broad surfaces. The through aperture arrangement (50) of the second dielectric slab (40) is elongated in a direction (32) skewed (by $\alpha$) relative to the direction of polarization (14') of the linearly polarized electromagnetic energy (14), so that a vertical component of the linearly polarized electromagnetic energy passing through the second dielectric slab (40) encounters a second effective vertical dielectric constant, the value of which is less than the value of the first effective vertical dielectric constant, and a horizontal component of the linearly polarized electromagnetic energy passing through the second dielectric slab (40) encounters a second effective horizontal dielectric constant, the value of which is less than the value of the first effective horizontal dielectric constant. The third generally planar dielectric slab (60) lies on the straight line (16) with one of the first (60*us*) and second (60*ls*) broad surfaces orthogonal to the straight line (16). The third dielectric slab (60) lies at a location on the straight line which is remote from the second dielectric slab (40) and from the source of linearly polarized electromagnetic energy (12). The third dielectric slab (60) defines at least one through aperture arrangement (70) extending from the first (60*us*) broad surface to the second (60*ls*) broad surface. The through aperture arrangement (70) of the third dielectric slab (60) is elongated in a direction (32) skewed ($\alpha$) relative to the direction of polarization (14') of the linearly polarized electromagnetic energy (14), so that a vertical component of the linearly polarized electromagnetic energy passing through the third dielectric slab encounters the second effective vertical dielectric constant and a horizontal component of the linearly polarized electromagnetic energy passing through the third dielectric slab (60) encounters the second effective horizontal dielectric constant. In a particular embodiment, the first effective vertical dielectric constant is selected to exceed the second effective vertical dielectric constant in a given ratio, and the first effective horizontal dielectric constant is selected to exceed the second effective horizontal dielectric constant in the same given ratio. The first (40*us*) surface of the second (40) dielectric slab in one embodiment is juxtaposed with the second (20*ls*) surface of the first (20) dielectric slab, and the first (20*us*) surface of the first (20) dielectric slab is juxtaposed with the second (60*ls*) surface of the third (60) dielectric slab. The juxtaposed surfaces may be fused together. In one version, the aperture arrangement comprises a slot defining the direction of elongation, and in another version, the aperture arrangement comprises a plurality of separate apertures lying along the direction of elongation. The first (20) and second (40) generally planar dielectric slabs have different bulk dielectric constants. One embodiment further comprises a stiffening dielectric panel affixed to at least one of the second and third dielectric slabs. This stiffening dielectric panel has an isotropic dielectric constant in a direction parallel to the straight line (16). Alternatively, the source may comprise a honeycomb dielectric panel (80*a*, 80*b*) affixed to at least one of the first, second and third dielectric slabs, the honeycomb dielectric panel having an isotropic dielectric constant in a direction parallel to the straight line (16).

A method according to another aspect of the disclosure is for making a phase shifter for electromagnetic energy. The method comprises the steps of stacking a plurality of generally planar dielectric sheets to produce a stack (600) of dielectric sheets, with those dielectric sheets (20) toward the center of the stack (600) being selected to have a greater bulk dielectric constant than those dielectric sheets (40, 60) toward the ends of the stack (600). The mutually adjacent surfaces of the dielectric sheets of the stack are fused to thereby generate a unitary structure. The fusion may be heat fusion. A first elongated aperture arrangement is generated, the aperture arrangement extending through all of the dielectric sheets of the stack. The first elongated aperture arrangement defines an axis of elongation. At least a second elongated aperture arrangement extending through all of the dielectric sheets of the stack is generated. The second elongated aperture has an axis of elongation parallel to the axis of elongation of the first elongated aperture arrangement. In a particular mode of this method, the step of generating a first elongated aperture arrangement comprises the step of generating a first elongated slot defining the axis of elongation, and the step of generating a second elongated aperture arrangement comprises the step of generating a second elongated slot defining an axis of elongation parallel to the axis of elongation of the first slot. In an alternative mode of the method, the step of generating a first elongated aperture arrangement comprises the step of generating a series of mutually separated apertures, the mutually separated apertures of the first aperture arrangement extending along the axis of elongation, and step of generating a second elongated aperture arrangement comprises the step of generating a series of mutually separated apertures, the mutually separated apertures of the second elongated aperture arrangement extending along an axis of elongation which is parallel with the axis of elongation of the first aperture arrangement.

What is claimed is:

1. A source of nominally circularly polarized electromagnetic energy, said source comprising:

a source of linearly polarized electromagnetic energy, said linearly polarized electromagnetic energy propagating parallel to a given straight line away from said source of linearly polarized electromagnetic energy;

a first dielectric slab lying on said line orthogonal to said straight line, said first dielectric slab defining at least a first aperture arrangement, said first aperture arrangement being elongated in a direction skewed relative to the direction of polarization of said linearly polarized electromagnetic energy, so that a vertical component of said linearly polarized electromagnetic energy passing through said first dielectric slab encounters a first effective vertical dielectric constant and a horizontal component of said linearly polarized electromagnetic energy passing through said first dielectric slab encounters a first effective horizontal dielectric constant, the value of which is different than said first effective vertical dielectric constant;

second and third dielectric slabs, said second dielectric slab lying on said straight line orthogonal to said line, said second dielectric slab lying at a location on said straight line between said source of linearly polarized electromagnetic energy and said first dielectric slab, said second dielectric slab defining at least one through aperture arrangement, said through aperture arrangement of said second dielectric slab being elongated in a direction skewed relative to the direction of polarization of said linearly polarized electromagnetic energy, so that a vertical component of said linearly polarized electromagnetic energy passing through said second dielectric slab encounters a second effective vertical dielectric constant, the value of which is less than the value of said first effective vertical dielectric constant, and a horizontal component of said linearly polarized electromagnetic energy passing through said second dielectric slab encounters a second effective horizontal dielectric constant, the value of which is less than the value of said first effective horizontal dielectric constant, said third dielectric slab lying on said straight line orthogonal to said straight line, said third dielectric slab lying at a location on said straight line remote from said second dielectric slab and from said source of linearly polarized electromagnetic energy, said third dielectric slab defining at least one through aperture arrangement, said through aperture arrangement of said third dielectric slab being elongated in a direction skewed relative to the direction of polarization of said linearly polarized electromagnetic energy, so that a vertical component of said linearly polarized electromagnetic energy passing through said third dielectric slab encounters said third effective vertical dielectric constant and a horizontal component of said linearly polarized electromagnetic energy passing through said third dielectric slab encounters said third effective horizontal dielectric constant.

2. A source according to claim 1, wherein said first effective vertical dielectric constant is selected to exceed said second effective vertical dielectric constant in a given ratio, and said first effective horizontal dielectric constant is selected to exceed said second effective horizontal dielectric constant in said same given ratio.

3. A source according to claim 1, wherein:

a first surface of said second dielectric slab is juxtaposed with a second surface of said first dielectric slab, and a first surface of said first dielectric slab is juxtaposed with a second surface of said third dielectric slab.

4. A source according to claim 3, wherein said juxtaposed surfaces of said slabs are fused together.

5. A source according to claim 1, wherein said aperture arrangement comprises a slot defining said direction of elongation.

6. A source according to claim 1, wherein said aperture arrangement comprises a plurality of separate apertures lying along said direction of elongation.

7. A source according to claim 1, wherein said first and second dielectric slabs have different bulk dielectric constants.

8. A source according to claim 1, further comprising a stiffening dielectric panel affixed to at least one of said second and third dielectric slabs, said stiffening dielectric panel having an isotropic dielectric constant in a direction parallel to said straight line.

9. A source according to claim 1, further comprising a honeycomb dielectric panel affixed to at least one of said first, second and third dielectric slabs, said honeycomb dielectric panel having an isotropic dielectric constant in a direction parallel to said straight line.

10. A method for making a phase shifter for electromagnetic energy, said method comprising the steps of:

stacking a plurality of generally planar dielectric sheets to produce a stack of dielectric sheets, with those dielectric sheets toward the center of said stack being selected to have a greater dielectric constant than those dielectric sheets toward the ends of said stack;

fusing the mutually adjacent surfaces of said dielectric sheets of said stack to thereby generate a unitary structure;

generating a first elongated aperture arrangement extending through all of said dielectric sheets of said stack, said first elongated aperture arrangement defining an axis of elongation; and generating at least a second elongated aperture arrangement extending through all of said dielectric sheets of said stack, said second elongated aperture having an axis of elongation parallel to said axis of elongation of said first elongated aperture arrangement.

11. A method according to claim 10, wherein:

said step of generating a first elongated aperture arrangement comprises the step of generating a first elongated slot defining said axis of elongation; and said step of generating a second elongated aperture arrangement comprises the step of generating a second elongated slot defining an axis of elongation parallel to said axis of elongation of said first slot.

12. A method according to claim 10, wherein:

said step of generating a first elongated aperture arrangement comprises the step of generating a series of mutually separated apertures, said mutually separated apertures of said first aperture arrangement extending along said axis of elongation; and said step of generating a second elongated aperture arrangement comprises the step of generating a series of mutually separated apertures, said mutually separated apertures of said second elongated aperture arrangement extending along an axis of elongation which is parallel with said axis of elongation of said first aperture arrangement.

13. A source of nominally circularly polarized electromagnetic energy, said source comprising:

a source of linearly polarized electromagnetic energy, said linearly polarized electromagnetic energy propagating parallel to a given straight line away from said source of linearly polarized electromagnetic energy;

a first dielectric slab lying on said line orthogonal to said straight line, said first dielectric slab defining at least a first aperture arrangement, said first aperture arrangement being elongated in a direction skewed relative to the direction of polarization of said linearly polarized electromagnetic energy, so that a vertical component of said linearly polarized electromagnetic energy passing through said first dielectric slab encounters a first effective vertical dielectric constant and a horizontal component of said linearly polarized electromagnetic energy passing through said first dielectric slab encounters a first effective horizontal dielectric constant, the value of which is different than said first effective vertical dielectric constant;

second and third dielectric slabs, said second dielectric slab lying on said straight line orthogonal to said line, said second dielectric slab lying at a location on said straight line between said source of linearly polarized electromagnetic energy and said first dielectric slab, said second dielectric slab defining at least one through aperture arrangement registered with said first aperture arrangement, said through aperture arrangement of said second dielectric slab being elongated in a direction skewed relative to the direction of polarization of said linearly polarized electromagnetic energy, so that a vertical component of said linearly polarized electromagnetic energy passing through said second dielectric slab encounters a second effective vertical dielectric constant, the value of which is less than the value of said first effective vertical dielectric constant, and a horizontal component of said linearly polarized electromagnetic energy passing through said second dielectric slab encounters a second effective horizontal dielectric constant, the value of which is less than the value of said first effective horizontal dielectric constant, said third dielectric slab lying on said straight line orthogonal to said straight line, said third dielectric slab lying at a location on said straight line remote from said second dielectric slab and from said source of linearly polarized electromagnetic energy, said third dielectric slab defining at least one through aperture arrangement registered with said first aperture arrangement, said through aperture arrangement of said third dielectric slab being elongated in a direction skewed relative to the direction of polarization of said linearly polarized electromagnetic energy, so that a vertical component of said linearly polarized electromagnetic energy passing through said third dielectric slab encounters said third effective vertical dielectric constant, the value of which is less than the value of said first effective vertical dielectric constant, and a horizontal component of said linearly polarized electromagnetic energy passing through said third dielectric slab encounters said third effective horizontal dielectric constant, the value of which is less than the value of said first effective horizontal dielectric constant.

14. A source according to claim 13, wherein said first effective vertical dielectric constant is selected to exceed said second effective vertical dielectric constant in a given ratio, and said first effective horizontal dielectric constant is selected to exceed said second effective horizontal dielectric constant in said same given ratio.

15. A source according to claim 13, wherein:

a first surface of said second dielectric slab is juxtaposed with a second surface of said first dielectric slab, and a first surface of said first dielectric slab is juxtaposed with a second surface of said third dielectric slab.

16. A source according to claim 13, wherein said juxtaposed surfaces of said slabs are fused together.

17. A source according to claim 13, wherein said aperture arrangement comprises one or both of a slot defining said direction of elongation or a plurality of separate apertures lying along said direction of elongation.

18. A source according to claim 13, wherein said first and second dielectric slabs have different bulk dielectric constants.

19. A source according to claim 13, further comprising a stiffening dielectric panel affixed to at least one of said second and third dielectric slabs, said stiffening dielectric panel having an isotropic dielectric constant in a direction parallel to said straight line.

20. A source according to claim 13, further comprising a honeycomb dielectric panel affixed to at least one of said first, second and third dielectric slabs, said honeycomb dielectric panel having an isotropic dielectric constant in a direction parallel to said straight line.

* * * * *